US008117802B1

(12) United States Patent
Kisch et al.

(10) Patent No.: US 8,117,802 B1
(45) Date of Patent: Feb. 21, 2012

(54) PREFABRICATED STRUCTURAL ELEMENT

(76) Inventors: Dennis R. Kisch, Yankton, SD (US); Timothy D. Frohreich, Yankton, SD (US)

( * ) Notice: Subject to any disclaimer, the term of this patent is extended or adjusted under 35 U.S.C. 154(b) by 0 days.

(21) Appl. No.: 11/333,469

(22) Filed: Jan. 17, 2006

(51) Int. Cl.
*E04C 3/00* (2006.01)

(52) U.S. Cl. ..... 52/844; 52/836; 52/839; 52/DIG. 8

(58) Field of Classification Search ..... 52/729.4, 52/404.3, 730.7, 731.2, 731.3, 737.6, DIG. 8, 52/838, 839, 841, 844, 843, 836, 834, 847
See application file for complete search history.

(56) References Cited

U.S. PATENT DOCUMENTS

| | | | | |
|---|---|---|---|---|
| 1,368,594 | A | 2/1921 | Aatila | |
| 1,752,103 | A * | 3/1930 | Morrison | 52/765 |
| 3,256,662 | A | 6/1966 | Powers | |
| 4,020,612 | A | 5/1977 | Welch | |
| 4,106,254 | A * | 8/1978 | Jack et al. | 52/574 |
| 4,741,144 | A * | 5/1988 | Graffin | 52/847 |
| 4,765,105 | A * | 8/1988 | Tissington et al. | 52/309.11 |
| 5,207,046 | A * | 5/1993 | Vekkeli | 52/844 |
| 5,625,996 | A | 5/1997 | Bechtel | |
| 5,653,080 | A * | 8/1997 | Bergeron | 52/839 |
| 5,966,894 | A * | 10/1999 | Crump, Jr. | 52/841 |
| 6,389,762 | B2 | 5/2002 | Le Poire | |
| 6,401,405 | B1 | 6/2002 | Hicks | |
| 6,430,881 | B1 | 8/2002 | Daudet et al. | |
| 6,519,912 | B1 * | 2/2003 | Eckmann et al. | 52/847 |
| 6,560,938 | B1 | 5/2003 | Powers, Jr. | |
| 6,772,572 | B2 * | 8/2004 | Henthorn | 52/847 |
| 6,907,707 | B2 * | 6/2005 | Deiter | 52/847 |
| 2001/0004815 | A1 | 6/2001 | LePoire | |
| 2004/0016182 | A1 | 1/2004 | Kerr | |
| 2004/0049997 | A1 | 3/2004 | Wheeler | |
| 2004/0065031 | A1 * | 4/2004 | Steinberg et al. | 52/287.1 |
| 2007/0107367 | A1 * | 5/2007 | Kermani et al. | 52/729.4 |

* cited by examiner

*Primary Examiner* — Jessica Laux
*Assistant Examiner* — Ryan Kwiecinski
(74) *Attorney, Agent, or Firm* — Jeffrey A. Proehl; Woods, Fuller, Shultz & Smith, PC

(57) ABSTRACT

A structural element for use in forming a structure, that includes first and second longitudinal members that extend between opposite ends of the element. The longitudinal members have inward and outward faces, and a pair of side faces extending between the inward and outward faces. The element includes first and second lateral members that extend between the first and second longitudinal members. The first and second lateral members each have an outer surface. The outer surface of the first lateral member is substantially flush with a side face of each longitudinal member to form a substantially planar surface extending across substantially an entirety of a first side surface of the element. The outer surface of the second lateral member is substantially flush with a side face of each longitudinal member to form a substantially planar surface extending across substantially an entirety of a first side surface of the element.

13 Claims, 2 Drawing Sheets

PREFABRICATED STRUCTURAL ELEMENT

BACKGROUND OF THE INVENTION

1. Field of the Invention

The present invention relates to structure-forming elements and more particularly pertains to a new prefabricated structural element that facilitates the construction of a building by providing a preformed element that is easily cut to fit differently-sized openings in a building and that facilitate the finishing of the interior of the building after the element is installed.

2. Description of the Prior Art

In the construction of a building or other structure, it is often desirable to create openings for doors and windows to permit egress and allow for light passage and ventilation. These openings require reinforced structural elements to be positioned above the opening to support the portion of the wall above the opening, and an element typically referred to as a "header" is employed that has greater strength than the usual stud-and-bay arrangement employed in the rest of the wall. Headers are most commonly formed by the wall framers on-site, using two or three 2"×4" or 2"×6" (or larger) boards that are nailed or otherwise fastened together and placed on edge above the opening. The on-site construction of the header can be relatively time consuming as compared to other framing done on-site, and fastener placement in the boards may not be optimal for the greatest strength. The fabrication of headers in this manner does not always result in a structural element that is the same thickness as the rest of the wall, which can cause gaps in the interior of the wall. The header formed of boards abutted against each other may also have a relatively lesser insulation characteristic as compared to the rest of the insulation filled wall.

Various prefabricated structural members have been proposed for use as headers (or as other structural elements) in buildings, which can eliminate the need to perform on-site fabrication and provide a more uniform quality for the header, but the known designs tend to employ a modified I-beam or box-beam configuration that can form gaps in the resulting walls which in turn may complicate insulation installation in the wall, as well as the finishing of the wall (such as with wall board) and the installation of decorative elements (such as curtain rods that tend to be installed above openings in a structure).

For example, U.S. Pat. No. 5,966,894 to Crump, Jr. shows a framing beam assembly that combines a box beam and an I-beam design, but is fabricated out of a multiplicity of parts and only has a limited area on a side which can be securely fastened to due to the positioning of a relatively soft insulation material on the side of the beam assembly. The additional parts complicates the assembly and inevitably makes it more expensive to assemble, and the limited area for secure attachment is positioned more toward one side of the beam assembly and thus requires that the builder make sure at each use that the correct side is positioned downwardly.

Therefore, it is believed that an improved prefabricated structural element is needed that can be employed in the construction of buildings, particularly as headers above opening in the building.

SUMMARY OF THE INVENTION

In view of the foregoing disadvantages inherent in the known types of structure-forming elements now present in the prior art, the present invention provides a new prefabricated structural element wherein the same facilitates the construction of a building by providing a preformed element that is easily cut to fit differently-sized openings in a building and that facilitate the finishing of the interior of the building after the element is installed.

To attain this, the present invention generally comprises a structural element for use in forming a structure, with the structural element having opposite longitudinal ends. The structural element includes a first longitudinal member extending between the opposite ends of the structural element, and the first longitudinal member has an inward face, an outward face, and a pair of side faces each extending between the inward and outward faces. The structural element further includes a second longitudinal member extending between the opposite ends of the structural element, with the second longitudinal member having an inward face, an outward face, and a pair of side faces each extending between the inward and outward faces. The element also includes a first lateral member that extends between the first longitudinal member and the second longitudinal member, and the first lateral member having an outer surface. The structural element further includes a second lateral member that extends between the first longitudinal member and the second longitudinal member, and the second lateral member has an outer surface.

In some embodiments of the invention, the outer surface of the first lateral member is substantially flush with one of the side faces of the first longitudinal member and one of the side faces of the second longitudinal member to form a substantially planar surface extending across substantially an entirety of a first side surface of the structural element. Similarly, the outer surface of the second lateral member is substantially flush with one of the side faces of the first longitudinal member and one of the side faces of the second longitudinal member to form a substantially planar surface extending across substantially an entirety of a second side surface of the structural element.

In some embodiments, a pair of grooves may be formed on the inward face of the first longitudinal member, with each of the grooves being positioned adjacent to and spaced from a respective one of the side faces of the first longitudinal member. Similarly, a pair of grooves may be formed on the inward face of the second longitudinal member, with each of the grooves being positioned adjacent to and spaced from a respective one of the side faces of the second longitudinal member. A tongue may extend from each of the opposite edge faces of the first lateral member, and the tongue on each of the edge faces of the first lateral member is positioned in one of the grooves of one of the longitudinal members. A tongue may extend from each of the opposite edge faces of the second lateral member, with the tongue on each of the edge faces of the second lateral member being positioned in one of the grooves of one of the longitudinal members.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Advantages of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects of the invention will become apparent when consideration is given to the following detailed description thereof. Such description makes reference to the annexed drawings wherein.

DESCRIPTION OF PREFERRED EMBODIMENTS

Figure 1:
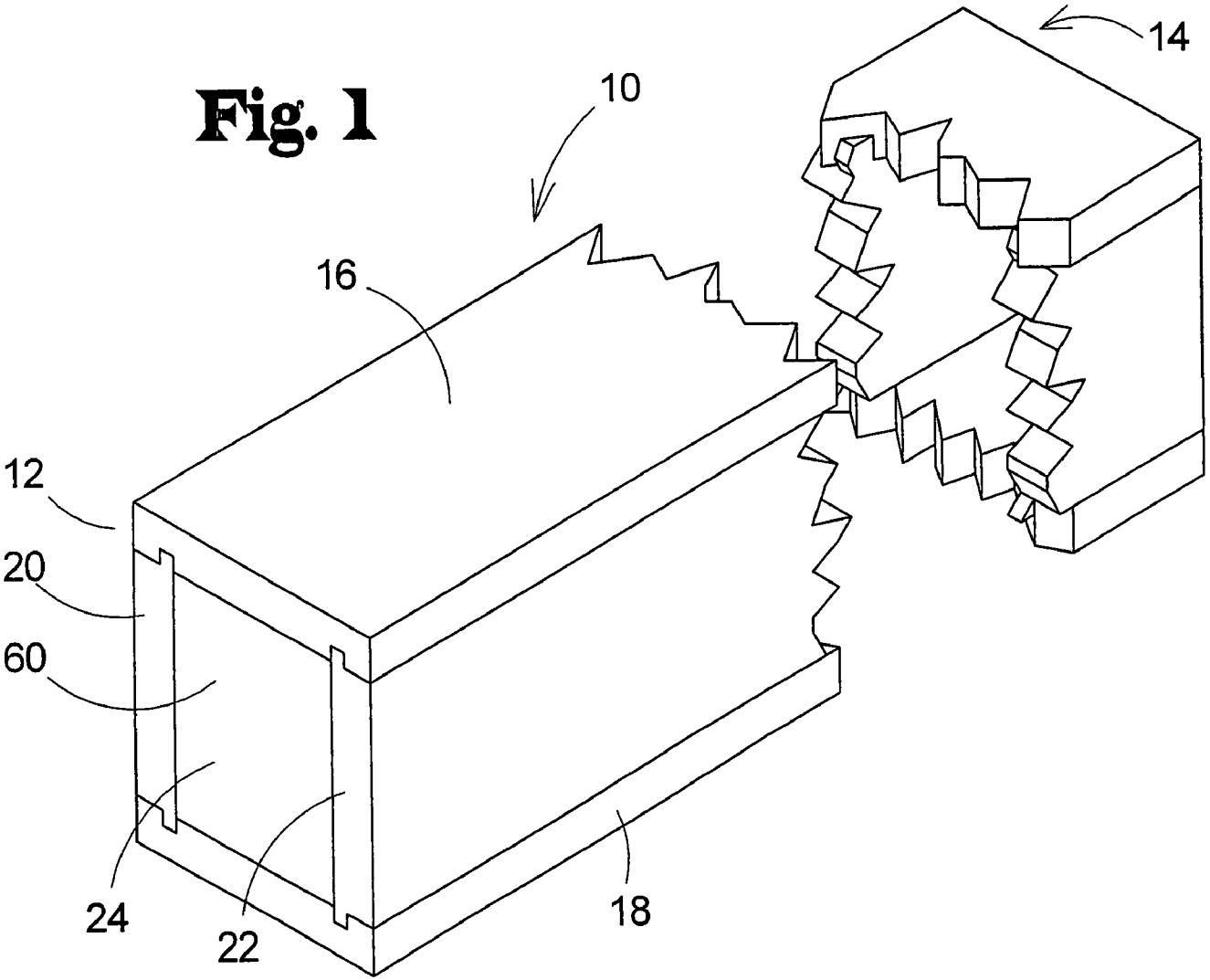
FIG. 1 is a schematic perspective view of the new prefabricated structural element according to the present invention.
Figure 2:
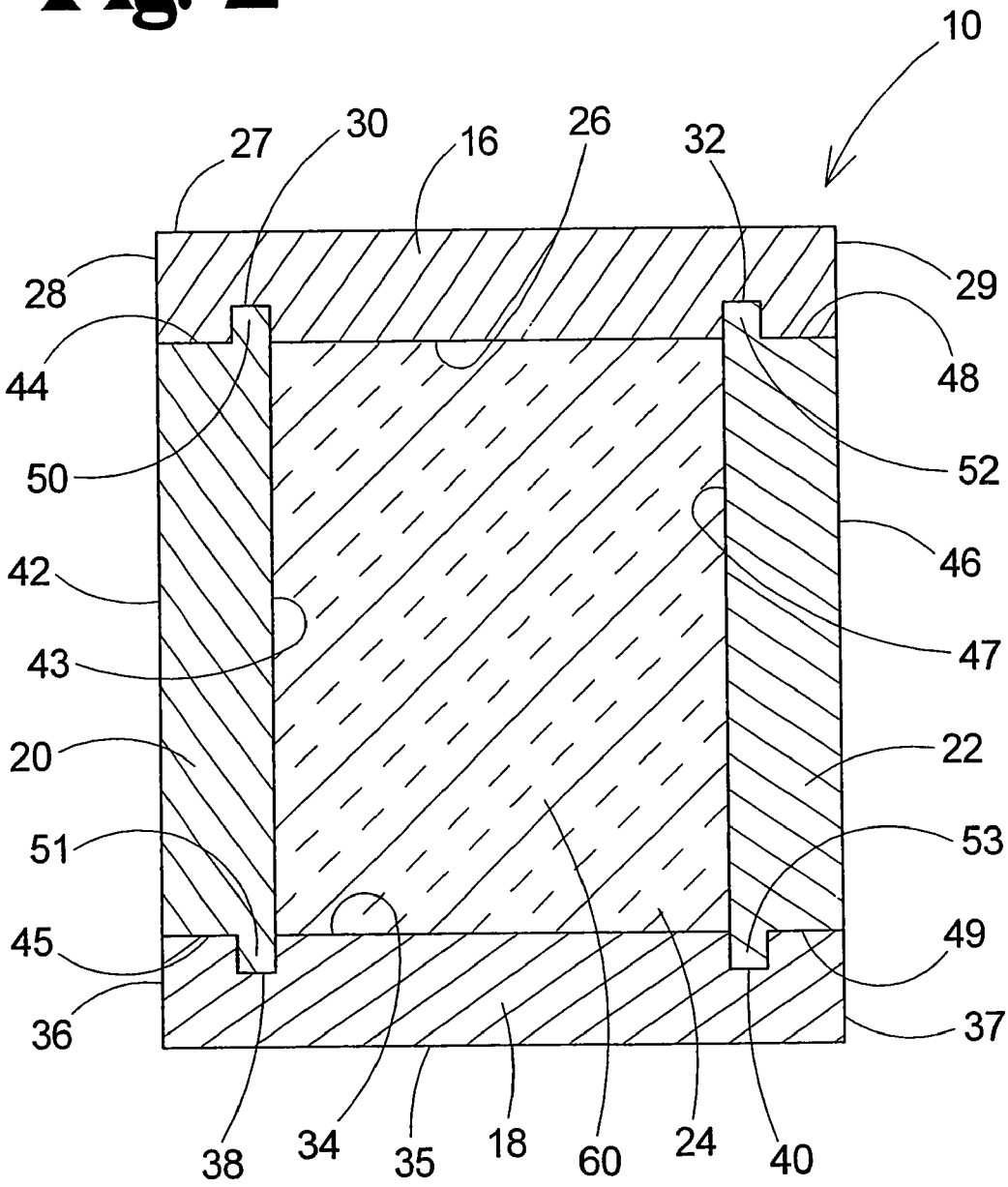
FIG. 2 is a schematic sectional view of the present invention.

With reference now to the drawings, and in particular to FIGS. 1 and 2 thereof, a new prefabricated structural element embodying the principles and concepts of the present invention and generally designated by the reference numeral 10 will be described.

The structural element 10 of the invention is highly suitable for use in the construction of a building or other structure, and is especially useful for, although is not limited to, forming the framing elements above openings in the building structure sometimes referred to as a "header". The structural element 10 has opposite longitudinal ends 12, 14 that may be rested on and attached to supporting elements, such as vertical structures in a wall.

The structural element 10 of the invention may comprise a first longitudinal member 16 and a second longitudinal member 18, and a first lateral member 20 and a second lateral member 22. The members 16, 18, 20, 22 each extend between the opposite longitudinal ends 12, 14 of the element 10. The members 16 through 22 are arranged so that they define an interior channel 24 therebetween, and extend from one end 14 to the other end 16 of the element 10. The channel 24 may be continuously and uninterruptedly circumscribed by the members 16 through 22.

The first longitudinal member 16 extends between the opposite ends 12, 14 of the structural element 10. The first longitudinal member 16 has an inward face 26 and an outward face 27. The outward face 27 may form one of the exterior bearing surfaces of the structural element 10. The first longitudinal member 16 also has a pair of side faces each extending between the inward face and the outward face of the first longitudinal member.

A groove 30 is formed on the inward face 26 of the first longitudinal member 16, and may be positioned at a spaced location from one 28 of the side faces of the member 16. In some of the most preferred embodiments, a pair of grooves 30 and 32 is formed on the inward face 26 of the first longitudinal member. Each of the grooves 30, 32 may thus be positioned adjacent to or relatively proximate to, but spaced from, a respective one of the side faces of the first longitudinal member.

The second longitudinal member 18 extends between the opposite ends 12, 14 of the element 10, and includes an inward face 34 and an outward face 35. The inward face 34 of the second longitudinal member 18 is oriented toward the inward face 26 of the first longitudinal member 16. The second longitudinal member 18 may be positioned a substantially uniform distance from the first longitudinal member 16 between the opposite ends 12, 14 of the structural element 10. The second longitudinal member 18 has a pair of side faces 36, 37 that each extend between the inward face 34 and the outward face 35 of the second longitudinal member.

A groove 38 is also formed on the inward face 34 of the second longitudinal member 18, and may be positioned at a spaced location from one of the side faces 36 of the second longitudinal member 18. The groove 38 may be positioned in opposition to the groove 30 on the first longitudinal member 16. Similar to the first longitudinal member, a pair of grooves 38 and 40 is formed on the inward face 34 of the second longitudinal member 18, and each of the grooves 38 and 40 may be positioned adjacent to and spaced from a respective one of the side faces 36, 37 of the second longitudinal member. Each groove 38, 40 of the pair of grooves in the second longitudinal member may be positioned in opposition to a respective one of the grooves 30 32 in the in the first longitudinal member 16.

The first lateral member 20 extends between the first 16 and second 18 longitudinal members, and has an outer surface 42 as well as an inner surface 43. The first lateral member 20 has a pair of opposite edge faces 44, 45. Similarly but not necessarily identically, the second lateral member 22 extends between the first longitudinal member 16 and the second longitudinal member 18, and has an outer surface 46 as well as an inner surface 47. The second lateral member 22 also has a pair of opposite edge faces 48, 49.

A significant feature of at least some embodiments of the invention is that the outer surface 42 of the first lateral member 20 is substantially flush with one 28 of the side faces of the first longitudinal member 16 and one 36 of the side faces of the second longitudinal member 18 to form a substantially planar surface extending across substantially the entire side surface of the structural element 10. Similarly, but again not necessarily identically, the outer surface 46 of the second lateral member 22 is substantially flush with one 29 of the side faces of the first longitudinal member 16 and one 37 of the side faces of the second longitudinal member 18 to form a substantially planar surface extending across substantially the entire side surface of the structural element 10. This relationship between the outer surfaces of the first 20 and second 22 lateral members and the respective side faces of the first 16 and second 18 longitudinal members is significant as it not only provides a substantially flat surface across the entire dimension of the side surface of the element 10 for positioning facing elements (such as wall board) against, but also facilitates fastening of such elements to the side of the element 10 as the entire, or substantially the entire, side surface of the element 10 is formed by the strength providing components (e.g. the members 16 through 22), and not by relatively weaker elements such as insulation materials. The members 16 through 22 are preferably formed of a wood-containing material such as, but not limited to, natural form wood, plywood, laminated wood, medium density fiberboard, or virtually any wood fiber-containing material that provides structural strength. Other types of materials that exhibit structural strength may also be used. It will be evident that the strength of the element 10 may be increased by increasing the relative thicknesses of the members, or changing the materials. These types of materials provide an ideal base for placing a wall surface forming material against, such as wall board, and also form a sturdy surface for fastening the wall board to at any location on the side surface of the element 10. Further, a gap is not formed between the lateral members and the wall board mounted against the element, so the mounting of supports, such as curtain rod supports, may be effected at any location on the wall board as the fastener of the support is highly likely to reach the lateral member of element 10 due to the positioning of the lateral member right behind the wallboard.

In another significant aspect of the invention that is employed on at least some embodiments of the invention, a tongue 50, 51 extends from each of the opposite edge faces 44, 45 of the first lateral member. Each of the tongues may comprise a portion of the member with a reduced width relative to the width of the lateral member between the inner and outer surfaces of the major portion of the lateral member. The tongues of a lateral member may be positioned relative to the inner and outer surfaces in a variety of relationships, but preferably the tongues 50, 51 may be spaced from the outer surface 42 of the first lateral member 20, and optionally may be substantially flush or even with the inner surface of the first lateral member. The tongues 50, 51 on each of the edge faces 44, 45 of the first lateral member 20 are positioned in respective grooves 30, 38 of the longitudinal members 16, 18. Similarly, but not necessarily identically, a tongue 52, 53 extends from each of the opposite edge faces 48, 49 of the second lateral member 22. The tongues 52, 53 are spaced from the outer surface 46 of the second lateral member 22. The tongues 52, 53 on each of the respective edge faces of the second lateral member are positioned in a respective groove 32, 40 of the longitudinal members 16, 18. The positioning of the tongues toward the inner surfaces 43, 47 of the lateral members and away from the outer surface 42, 46 of the lateral members permits the outer surface 42, 46 to be flushed up with the side faces of longitudinal members 16, 18, while also permitting the tongues to be inserted into a full groove with opposite sides that contact, and thus may be adhered to, the tongue that is inserted into the groove. This relationship enhances the strength of the bond between the longitudinal and lateral members formed by the tongue and groove structure.

The groove corresponding to a tongue may have a width slightly wider than the width of the tongue, or substantially the same as the width of the tongue, if an interference fit therebetween is desired. It will be appreciated that the spacing of each groove from the adjacent side face of the longitudinal member substantially corresponds to the offset of the tongue (that mates with the groove) from the outer surface of the respective lateral member.

Optionally, the width dimension of the tongues 50, 51 may be approximately one half of the thickness dimension of the respective lateral member from which it extends, although wider or narrower widths may be employed. In such an illustrative embodiment, the offset of the tongue from the respective outer surface of the respective lateral member is approximately one half of the width of the lateral member.

In some embodiments of the invention, an insulation material 60 is located in the interior channel 24 of the element 10 formed by the longitudinal members 16, 18 and the lateral members 20, 22. Optionally, the insulation material 60 may be formed exteriorly of the interior channel 24 and then inserted into the channel. For example, pieces of insulation board formed of expanded polystyrene may be slid into the interior channel after the members 16 through 22 of the element 10 are attached together, or may be inserted during the process of assembling the members. As a further option, the insulation material 60 may be foamed into the interior channel by spraying the components of an expanding foam material into the channel 24 allowing the foam to expand. The expanding foam may thus form a bond with at least one of the inner faces of one of the members.

The structural element 10 may thus be used as any other header or beam material, and may be supplied to the user in standard lengths that may be measured and cut into the needed length at the construction site using conventional techniques.

With respect to the above description then, it is to be realized that the optimum dimensional relationships for the parts of the invention, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

Index of Elements for
PREFABRICATED STRUCTURAL ELEMENT

| | |
|---|---|
| 1. | |
| 2. | |
| 3. | |
| 4. | |
| 5. | |
| 6. | |
| 7. | |
| 8. | |
| 9. | |
| 10. | structural member |
| 11. | |
| 12. | (first) opposite end of struct. member |
| 13. | |
| 14. | (second) opposite end of struct. memb. |
| 15. | |
| 16. | first longitudinal member |
| 17. | |
| 18. | second longitudinal member |
| 19. | |
| 20. | first lateral member |
| 21. | |
| 22. | second lateral member |
| 23. | |
| 24. | interior channel |
| 25. | |
| 26. | inward face of first long. member |
| 27. | outward face of first long. member |
| 28. | (first) side face of first long. member |
| 29. | (second) side face of first long. member |
| 30. | (first) groove in first long. member |
| 31. | |
| 32. | (second) groove in second long. memb. |
| 33. | |
| 34. | inward face of second long member |

-continued

| Index of Elements for PREFABRICATED STRUCTURAL ELEMENT | |
|---|---|
| 35. | outward face of second long member |
| 36. | (first) side face of second long. member |
| 37. | (second) side face of second long mem |
| 38. | (first) groove in second long member |
| 39. | |
| 40. | (second) groove in sec. long. member |
| 41. | |
| 42. | outer surface of first lat member |
| 43. | inner surface of first lateral member |
| 44. | (first) edge face of first lat member |
| 45. | (second) edge face of first lat member |
| 46. | outer surface of second lat member |
| 47. | inner surface of second lat member |
| 48. | (first) edge face of second lat. memb. |
| 49. | (second) edge face of second lat memb |
| 50. | (first) tongue on first lat member |
| 51. | (second) tongue on first lat member |
| 52. | (first) tongue on second lat member |
| 53. | (second) tongue on second lat memb |
| 54. | |
| 55. | |
| 56. | |
| 57. | |
| 58. | |
| 59. | |
| 60. | insulation material |
| 61. | |
| 62. | |
| 63. | |
| 64. | |
| 65. | |
| 66. | |
| 67. | |
| 68. | |
| 69. | |
| 70. | |
| 71. | |
| 72. | |
| 73. | |
| 74. | |
| 75. | |
| 76. | |
| 77. | |
| 78. | |
| 79. | |
| 80. | |

We claim:

1. A structural element for use in forming a structure, the structural element having opposite longitudinal ends, the structural element comprising:

a first longitudinal member extending between the opposite ends of the structural element, the first longitudinal member having an inward face, an outward face, and a pair of side faces each extending between the inward and outward faces, the first longitudinal member being formed from a structural material;

a second longitudinal member extending between the opposite ends of the structural element, the second longitudinal member having an inward face, an outward face, and a pair of side faces each extending between the inward and outward faces, the second longitudinal member being formed from a structural material;

a first lateral member extending between the first longitudinal member and the second longitudinal member, the first lateral member having an outer surface with opposite edge faces, the first lateral member being formed from a structural material;

a second lateral member extending between the first longitudinal member and the second longitudinal member, the second lateral member having an outer surface with opposite edge faces, the second lateral member being formed from a structural material;

wherein a pair of grooves is formed on the inward face of the first longitudinal member, each of the grooves being positioned adjacent to and spaced from a respective one of the side faces of the first longitudinal member;

wherein a pair of grooves is formed on the inward face of the second longitudinal member, each of the grooves being positioned adjacent to and spaced from a respective one of the side faces of the second longitudinal member, each groove of the pair of grooves in the second longitudinal member being positioned in opposition to one of the grooves in the first longitudinal member;

a tongue extending from each of the opposite edge faces of the first lateral member, the tongue on each of the edge faces of the first lateral member being positioned in one of the grooves of one of the longitudinal members;

a tongue extending from each of the opposite edge faces of the second lateral member, the tongue on each of the edge faces of the second lateral member being positioned in one of the grooves of one of the longitudinal members;

wherein the first and second longitudinal members and the first and second lateral members extend along an entirety of an outer perimeter surface of the structural element such that the entirety of the outer perimeter surface is formed of structural material;

wherein the first and second longitudinal members and the first and second lateral members define an interior channel therebetween;

an insulation material located in the interior channel and that substantially fills the interior channel;

wherein the outer surface of the first lateral member forms a portion of the outer perimeter surface of the structural element and is flush with one of the side faces of the first longitudinal member and one of the side faces of the second longitudinal member to form a planar surface extending across substantially an entirety of a first side surface of the outer perimeter surface of the structural element; and wherein the outer surface of the second lateral member forms a portion of the outer perimeter surface of the structural element and is flush with one of the side faces of the first longitudinal member and one of the side faces of the second longitudinal member to form a planar surface extending across substantially an entirety of a second side surface of the outer perimeter surface of the structural element wherein the structural material comprises a wood-containing material.

2. The structural element of claim 1 wherein the insulation material is of a character formed exteriorly of the interior channel and inserted into the channel.

3. The structural element of claim 1 wherein the insulation material is of a character that is foamed into the interior channel after assembly of the members.

4. A structural element for use in forming a structure, the structural element having opposite longitudinal ends, the structural element comprising:

a structural first longitudinal member extending between the opposite ends of the structural element and having an inward face, an outward face, and a pair of side faces each extending between the inward and outward faces;

a structural second longitudinal member extending between the opposite ends of the structural element and having an inward face, an outward face, and a pair of side faces each extending between the inward and outward faces;

a structural first lateral member extending between the first longitudinal member and the second longitudinal member, the first lateral member having an outer surface with opposite edge faces, a pair of grooves being formed on the inward face of the first longitudinal member, each of the grooves being positioned adjacent to and spaced from a respective one of the side faces of the first longitudinal member;

a structural second lateral member extending between the first longitudinal member and the second longitudinal member, the second lateral member having an outer surface with opposite edge faces, a pair of grooves being formed on the inward face of the second longitudinal member, each of the grooves being positioned adjacent to and spaced from a respective one of the side faces of the second longitudinal member, each groove of the pair of grooves in the second longitudinal member being positioned in opposition to one of the grooves in the first longitudinal member;

a tongue extending from each of the opposite edge faces of the first lateral member, the tongue on each of the edge faces of the first lateral member being positioned in one of the grooves of one of the longitudinal members;

a tongue extending from each of the opposite edge faces of the second lateral member, the tongue on each of the edge faces of the second lateral member being positioned in one of the grooves of one of the longitudinal members;

wherein the outer surface of the structural first lateral member forms a portion of the outer perimeter surface of the structural element and is flush with one of the side faces of the first longitudinal member and one of the side faces of the second longitudinal member to form a first side surface in a single plane extending across substantially an entirety of a distance between the outward faces of the first longitudinal member and the second longitudinal member;

wherein the outer surface of the structural second lateral member forms a portion of the outer perimeter surface of the structural element and is flush with one of the side faces of the first longitudinal member and one of the side faces of the second longitudinal member to form a second side surface in a single plane extending across substantially an entirety of a distance between the outward faces of the first longitudinal member and the second longitudinal member; and wherein the outer surfaces of the first and second longitudinal members and the first and second lateral members are continuous about the outer perimeter surface such that the outer perimeter surface is formed of a structural material wherein the structural material comprises a wood-containing material.

5. The structural element of claim 4 wherein the first and second longitudinal members and the first and second lateral members define an interior channel therebetween; and an insulation material located in the interior channel and that substantially fills the interior channel.

6. The structural element of claim 5 wherein the insulation material is of a character formed exteriorly of the interior channel and inserted into the channel.

7. The structural element of claim 5 wherein the insulation material is of a character that is foamed into the interior channel after assembly of the members.

8. A structural element for use in forming a structure, the structural element having opposite longitudinal ends, the structural element comprising:

a first longitudinal member extending between the opposite ends of the structural element and having an inward face, an outward face, and a pair of side faces each extending between the inward and outward faces;

a second longitudinal member extending between the opposite ends of the structural element and having an inward face, an outward face, and a pair of side faces each extending between the inward and outward faces;

a first lateral member extending between the first longitudinal member and the second longitudinal member, the first lateral member having an outer surface with opposite edge faces, a pair of grooves being formed on the inward face of the first longitudinal member, each of the grooves being positioned adjacent to and spaced from a respective one of the side faces of the first longitudinal member;

a second lateral member extending between the first longitudinal member and the second longitudinal member, the second lateral member having an outer surface with opposite edge faces, a pair of grooves being formed on the inward face of the second longitudinal member, each of the grooves being positioned adjacent to and spaced from a respective one of the side faces of the second longitudinal member, each groove of the pair of grooves in the second longitudinal member being positioned in opposition to one of the grooves in the first longitudinal member;

a tongue extending from each of the opposite edge faces of the first lateral member, the tongue on each of the edge faces of the first lateral member being positioned in one of the grooves of one of the longitudinal members;

a tongue extending from each of the opposite edge faces of the second lateral member, the tongue on each of the edge faces of the second lateral member being positioned in one of the grooves of one of the longitudinal members;

wherein the first and second longitudinal members and the first and second lateral members form a continuous outer perimeter surface of structural material;

wherein the outer surface of the first lateral member is flush with one of the side faces of the first longitudinal member and one of the side faces of the second longitudinal member to form a first side surface in which neither of the side faces of the first and second longitudinal members protrudes beyond a plane defined by the outer surface of the first lateral member; and wherein the outer surface of the second lateral member is flush with one of the side faces of the first longitudinal member and one of the side faces of the second longitudinal member to form a second side surface in which neither of the side faces of the first and second longitudinal members protrudes beyond a plane defined by the outer surface of the second lateral member wherein the structural material comprises a wood-containing material.

9. The structural element of claim 8 wherein the first and second longitudinal members and the first and second lateral members define an interior channel therebetween; and an insulation material located in the interior channel and that substantially fills the interior channel.

10. The structural element of claim 9 wherein the insulation material is of a character formed exteriorly of the interior channel and inserted into the channel.

11. The structural element of claim 9 wherein the insulation material is of a character that is foamed into the interior channel after assembly of the members.

12. The structural element of claim 8 wherein the first and second longitudinal members and the first and second lateral members form an entirety of the outer perimeter surface of the structural element.

13. The structural element of claim 8 wherein the planar surfaces extending across substantially the entireties of the first and second side surfaces of the outer perimeter surface of the structural element are configured to facilitate fastening of fasteners to the side surfaces.

* * * * *